US012421006B2

(12) United States Patent
Hofmann et al.

(10) Patent No.: US 12,421,006 B2
(45) Date of Patent: Sep. 23, 2025

(54) CONTAINER MADE OF PAPER

(71) Applicant: TUNAP GMBH & CO. KG, Wolfratshausen (DE)

(72) Inventors: André Hofmann, Mittweida (DE); Jochen Gruner, Dresden (DE); Steffen Herold, Chemnitz (DE)

(73) Assignee: LENZING AKTIENGESELLSCHAFT, Lenzing (AT)

( * ) Notice: Subject to any disclaimer, the term of this patent is extended or adjusted under 35 U.S.C. 154(b) by 272 days.

(21) Appl. No.: 18/041,172

(22) PCT Filed: May 27, 2021

(86) PCT No.: PCT/EP2021/064164
§ 371 (c)(1),
(2) Date: Feb. 9, 2023

(87) PCT Pub. No.: WO2022/033737
PCT Pub. Date: Feb. 17, 2022

(65) Prior Publication Data

US 2023/0356907 A1 Nov. 9, 2023

(30) Foreign Application Priority Data

Aug. 11, 2020 (DE) ..... 10 2020 121 103.1

(51) Int. Cl.
*B65D 3/22* (2006.01)
*B65D 3/04* (2006.01)
*B65D 77/06* (2006.01)

(52) U.S. Cl.
CPC ..... *B65D 77/06* (2013.01); *B65D 3/04* (2013.01); *B65D 3/22* (2013.01)

(58) Field of Classification Search
CPC . B65D 3/04; B65D 3/22; B65D 3/262; B65D 3/14; B65D 77/06
See application file for complete search history.

(56) References Cited

U.S. PATENT DOCUMENTS 1,417,707 A 5/1922 Wright
2,406,758 A * 9/1946 Gazette ..... B65D 3/22 229/5.5

(Continued)

FOREIGN PATENT DOCUMENTS

DE 2706936 A1 8/1978
DE 3322977 A1 1/1985

(Continued)

OTHER PUBLICATIONS

German Office action for Application No. 102020121103, dated Apr. 9, 2021, 6 pages.

(Continued)

*Primary Examiner* — Nathan J Newhouse
*Assistant Examiner* — Phillip D Schmidt
(74) *Attorney, Agent, or Firm* — Womble Bond Dickinson (US) LLP

(57) ABSTRACT

A container for holding a fluid is disclosed. The container comprises an inner sleeve having a first opening and a second opening opposite the first opening, and an outer sleeve having a third opening and a fourth opening opposite the third opening. The inner sleeve and the outer sleeve are made of paper. The first opening has a first reinforcing element which extends into the first opening, and the third opening has a second reinforcing element which extends into the third opening. Further, the container comprises a functional insert. The outer sleeve has a larger diameter than the inner sleeve so that the inner sleeve is insertable into the outer sleeve through the fourth opening such that the insert (Continued)

is fastened between the first reinforcing element and the second reinforcing element.

19 Claims, 5 Drawing Sheets

(56) References Cited

U.S. PATENT DOCUMENTS

| | | | | | |
|---|---|---|---|---|---|
| 2,618,883 | A * | 11/1952 | Morsink | B05B 11/062 222/398 |
| 3,662,944 | A * | 5/1972 | Joosten, Sr. | B65D 15/06 229/5.6 |
| 4,181,239 | A | 1/1980 | Heiremans et al. | |
| 4,267,928 | A * | 5/1981 | Curry, Jr. | B65D 83/0055 206/583 |
| 4,286,745 | A * | 9/1981 | Fukuoka | B32B 27/10 220/624 |
| 4,324,350 | A | 4/1982 | Thompson | |
| 4,560,063 | A | 12/1985 | Miller | |
| 4,890,786 | A | 1/1990 | Oberhofer et al. | |
| 5,084,284 | A | 1/1992 | McDilda et al. | |
| 5,217,164 | A * | 6/1993 | Sullivan | B65D 75/5888 206/385 |
| 5,971,259 | A | 10/1999 | Bacon | |
| 5,979,748 | A | 11/1999 | Drummond et al. | |
| 6,165,114 | A | 12/2000 | Stahlecker et al. | |
| 6,176,069 | B1 | 1/2001 | Kossendrup | |
| 6,196,408 | B1 | 3/2001 | Setty et al. | |
| 6,296,600 | B1 | 10/2001 | Drummond et al. | |
| 6,460,759 | B1 * | 10/2002 | Lowry | B65D 75/5888 229/101.2 |
| 6,675,971 | B2 | 1/2004 | Case | |
| 7,757,935 | B2 | 7/2010 | Clougherty | |
| 8,851,363 | B2 | 10/2014 | Stahlecker | |
| 9,180,995 | B2 | 11/2015 | Iyori et al. | |
| 9,758,292 | B2 | 9/2017 | Leser et al. | |
| 10,512,345 | B2 | 12/2019 | Garza et al. | |
| 11,603,232 | B2 | 3/2023 | Dregger et al. | |
| 11,691,777 | B2 * | 7/2023 | Dixon-Garrett | B65D 79/005 220/260 |
| 11,845,583 | B2 * | 12/2023 | West | B65D 3/22 |
| 2004/0142133 | A1 | 7/2004 | Coninck et al. | |
| 2005/0279814 | A1 | 12/2005 | Drummond | |
| 2008/0035639 | A1 | 2/2008 | Bast et al. | |
| 2012/0298731 | A1 | 11/2012 | Hargreaves et al. | |
| 2013/0334297 | A1 | 12/2013 | West et al. | |
| 2021/0009306 | A1 * | 1/2021 | Dixon-Ridges | B65D 77/225 |
| 2021/0292038 | A1 * | 9/2021 | Dudlak | B65D 3/28 |
| 2021/0380308 | A1 * | 12/2021 | West | B65D 23/0842 |
| 2022/0402670 | A1 * | 12/2022 | Van Zyll De Jong | B65D 65/466 |

FOREIGN PATENT DOCUMENTS

| | | | | | |
|---|---|---|---|---|---|
| DE | 2810065 | C2 | | 9/1985 | |
| DE | 68905745 | T2 | | 10/1993 | |
| DE | 19741859 | A1 | | 4/1999 | |
| DE | 10335937 | A1 | * | 3/2005 | B65D 3/22 |
| DE | 60012821 | T2 | | 9/2005 | |
| EP | 0893354 | B1 | | 7/1998 | |
| EP | 0949151 | A2 | | 10/1999 | |
| EP | 0967153 | A1 | | 12/1999 | |
| EP | 0909712 | B1 | | 10/2002 | |
| EP | 0952087 | B1 | | 12/2002 | |
| EP | 1002731 | B1 | | 6/2004 | |
| EP | 1149771 | B1 | | 1/2005 | |
| EP | 1526079 | B1 | | 10/2006 | |
| EP | 1607336 | B1 | | 3/2007 | |
| EP | 1870340 | B1 | | 7/2009 | |
| EP | 2509876 | B1 | | 4/2014 | |
| EP | 2447175 | B1 | | 6/2016 | |
| EP | 2540635 | B1 | | 10/2016 | |
| EP | 2720954 | B1 | | 9/2017 | |
| GB | 520052 | | | 4/1940 | |
| GB | 520052 | A | * | 4/1940 | |
| GB | 2622840 | A | * | 4/2024 | A45D 33/003 |
| JP | S5452436 | U | | 9/1952 | |
| JP | S474276 | Y1 | | 2/1972 | |
| JP | 2017210283 | A | | 11/2017 | |
| WO | 199212057 | A2 | | 7/1992 | |
| WO | 2002102670 | A1 | | 12/2002 | |
| WO | 2011143754 | A1 | | 11/2011 | |
| WO | 2012035792 | A1 | | 3/2012 | |
| WO | 2012116291 | A2 | | 8/2012 | |
| WO | 2018170240 | A1 | | 9/2018 | |
| WO | 2018224170 | A1 | | 12/2018 | |
| WO | WO-2021094825 | A1 | * | 5/2021 | B65D 75/5888 |

OTHER PUBLICATIONS

International Search Report and Written Opinion for Application No. PCT/EP2021/064164, dated Oct. 4, 2021, 12 pages.

* cited by examiner

CONTAINER MADE OF PAPER

CROSS-REFERENCE TO RELATED APPLICATIONS

This application is the U.S. national phase of International Application No. PCT/EP2021/064164 filed 27 May 2021 which designated the U.S. and claims priority to German Patent Application 10 2020 121 103.1 filed 11 Aug. 2020, the entire contents of each of which are hereby incorporated herein by reference.

TECHNICAL FIELD

Embodiments of the present disclosure relate to a container made of paper for holding (accommodating, receiving) a fluid or for holding a fluid-holding element. Further embodiments of the present disclosure relate to a method of manufacturing a container for holding a fluid or for holding a fluid-holding element.

BACKGROUND

Containers, in particular containers for holding a fluid, which are made of plastic (in particular polypropylene or polyethylene), metal or glass are known. Furthermore, cardboard composite materials with metallized or plastic-coated material layers are known, in particular in the food sector (e.g. milk packaging). Typically, such conventional containers are produced in manufacturing processes, e.g. injection molding, welding, glass blow molding or drawing and stretching processes. In general, the reusability or recyclability of conventional containers is rather low and very energy- and cost-intensive so that a large part of the conventional containers are disposed of as residual waste in a landfill or as fuel in a waste incineration plant. As a result, the $CO_2$ balance and the environmental sustainability of conventional containers, in particular containers designed to hold a fluid, is poor. The $CO_2$ balance is the balance of greenhouse gas emissions along the entire life cycle of a product in a defined application and related to a defined unit of use.

SUMMARY

There may be a need to provide sustainable containers, in particular containers for holding a fluid, which are properly recyclable, reusable or compostable.

These needs may be met by the subject matter of the independent claims. Advantageous embodiments of the present disclosure are described in the dependent claims.

In accordance with a first aspect of the disclosure, a container for holding a fluid is described. The container comprises an inner sleeve having a first opening and a second opening opposite the first opening. Further, the container comprises an outer sleeve having a third opening and a fourth opening opposite the third opening. The inner sleeve and the outer sleeve are made of paper. The first opening has a first reinforcing element (reinforcing member) which extends (from the lateral or skin surface of the inner sleeve) into the first opening, and the third opening has a second reinforcing element which extends (from the skin surface of the outer sleeve) into the third opening. Further, the container has a functional insert. The outer sleeve has a larger diameter than the inner sleeve so that the inner sleeve is insertable into the outer sleeve through the fourth opening such that the insert is fastened (attached, fixed, secured), for example clamped or glued, between the first reinforcing element and the second reinforcing element.

In accordance with another aspect of the disclosure, a method of manufacturing a container for holding a fluid is described. The method comprises the steps of: (i) providing an inner sleeve having a first opening and a second opening opposite the first opening; (ii) providing an outer sleeve having a third opening and a fourth opening opposite the third opening, wherein the inner sleeve and the outer sleeve are made of paper; (iii) providing a first reinforcing element at the first opening, which first reinforcing element extends into the first opening; (iv) providing a second reinforcing element at the third opening, which second reinforcing element extends into the third opening; and (v) providing a functional insert, wherein the outer sleeve has a larger diameter than the inner sleeve so that the inner sleeve is insertable into the outer sleeve through the fourth opening such that the insert is fastened between the first reinforcing element and the second reinforcing element.

In the context of the disclosure, a container may represent a bottle or a can configured to hold (accommodate, receive, contain) a fluid, in particular a liquid or a cream-like fluid, or a fluid-holding element, in particular for aerosols or gaseous fluids. Exemplary embodiments may thus include spray cans, in particular spray cans comprising an inflated bag system, spray bottles, cream cans, drinking bottles, and aerosol cans.

The sleeve may be a tubular, elongated, cylindrical solid sleeve. In an exemplary embodiment, a tubular, elongated, cylindrical sleeve is characterized in that it has two openings, the two openings being opposite along a longitudinal direction and representing the top surfaces of, for example, a cylinder. In particular, the sleeve may form a rotationally symmetrical body whose axis of symmetry (central axis) is parallel to the longitudinal direction. The sleeve, which corresponds to the lateral or skin surface of a cylinder, may be provided homogeneously, i.e. without further openings or recesses in the skin surface. Alternatively, there may be at least one further opening or recess in addition to the two openings, which are opposite and may represent the top surfaces of a cylinder. The sleeve may have a diameter of at least 25 mm (millimeters), in particular 25 mm to 120 mm, further in particular 35 mm to 65 mm.

In the context of the disclosure, an "extending" of a reinforcing element into a corresponding opening may represent that the reinforcing element extends from the inner surface or skin surface of the sleeve into the corresponding opening into the interior of the sleeve, i.e., into an inner volume. The radial direction is orthogonal to and intersects the longitudinal direction of the sleeve or the central axis of the sleeve.

In the context of the application, the term "reinforcing element" may represent a full or partial circumferential bead which extends from the skin surface of the sleeve into the interior or inner volume of the sleeve and which contributes to the stiffening, mechanical strength and dimensional stability of the sleeve. Furthermore, the reinforcing element may provide a stop which defines a depth of penetration in the longitudinal direction of a sleeve inserted into a further sleeve and which prevents complete slippage in the direction with which a sleeve has been inserted into a further sleeve. The reinforcing element may form an integral portion of the sleeve or may consist of a separate element that is materially different from the sleeve. The reinforcing element may also constitute a plurality of bead segments of the bead, which are not fully circumferential and which extend into the interior of the sleeve. In this case, the reinforcing element may extend 1%, in particular 10% or 20% of the diameter of the sleeve inward in the radial direction. In addition, the reinforcing element may extend not only radially inwards but also 1%, in particular 10% or 20%, of the length of the sleeve in the longitudinal direction from the corresponding opening.

In the context of the application, the term "paper" represents a flat material consisting, for example, of a fibrous material, in particular of vegetable origin (e.g. pulp, wood pulp and waste paper pulp). Exemplary embodiments of "paper" included paper as well as cardboard and paperboard, which are distinguished on the basis of their mass per unit area (basis weight, grammage) according to DIN 6730. DIN 6730 defines that paper has a basis weight of 7 $g/m^2$ to 225 $g/m^2$, cardboard has a basis weight of 150 $g/m^2$ to 600 $g/m^2$, and paperboard has a basis weight of 225 $g/m^2$ and above. Further, exemplary embodiments of "paper" may include thin wood layers or cork layers having a thickness similar to paper. Further, the paper may include up to 5% foreign matter.

In the context of the application, the "functional insert" may represent an element or device, which serves to fill and/or empty or dispense the contents of the container. Further, the functional insert may represent a support member for a bag in which the fluid is contained. Exemplary embodiments of the functional insert are elements which may be made of plastic or metal and which may be made by casting processes, forging processes, CNC milling or turning, additive manufacturing processes, or injection molding processes. Thus, exemplary embodiments of the functional insert may include valve carriers for supporting a fluid outflow valve, threaded inserts for securing closures, such as screw caps, fluid reservoirs with or without expandable fluid reservoirs, cartridges, pressure cartridges, gas cartridges, baffle closures, aerosol valve receptacles, or pumping devices. The functional insert cannot be made of the same material as the sleeves.

The functional insert has a diameter which is smaller than the diameter of the outer sleeve. Furthermore, the diameter of the functional insert is larger than the free diameter of the third opening, which is not restricted or constrained by the second reinforcing element. Thus, the functional insert can be inserted through the fourth opening of the outer sleeve and be applied to the second reinforcing element. Further, the diameter of the functional insert is larger than the free diameter of the first opening, which is not restricted or constrained by the first reinforcing element. Thus, after the functional insert is applied to the second reinforcing element, the inner sleeve may be pushed or inserted into the outer sleeve so that the inner sleeve and the first reinforcing element press the functional insert against the first reinforcing element. The functional insert is thus clamped and fixed between the first reinforcing element and the second reinforcing element so that a tight fit of the functional insert is generated. A further connection, e.g. adhesive connection, between the functional insert and the inner or outer sleeve may be dispensed with. Accordingly, after the inner and outer sleeves have been detached from each other, the functional insert can be removed quickly and without leaving any residue so that a quick separation (waste separation) between the paper sleeves and the plastic insert is possible. The container according to the disclosure for holding a fluid may have a good CO2 balance as well as environmental compatibility and thus serves to reduce non-recyclable waste, since the outer and inner sleeves made of paper are easily separable from the functional insert made of plastic or metal. This is enabled by the fact that the container, i.e. both the inner sleeve and the outer sleeve, is made of paper. The manufacture of the container from paper also enables containers to be adapted in terms of height, diameter and material thickness and to be formed with visual designs, e.g. multicolored, or haptic designs, e.g. embossed, without great effort and expense. This also makes it possible to economically manufacture the containers in small batches. Furthermore, a functional element, e.g. a recessed grip for improved handling of the container and/or a pleat for positive (form-locking) resealing of the container, may also be provided in the outer paper sleeve.

According to another exemplary embodiment of the disclosure, the diameter of the inner sleeve and the diameter of the outer sleeve are configured such that an outer surface of the inner sleeve and an inner surface of the outer sleeve are frictionally coupled to each other.

A frictional (force-locked) coupling is a connection of two sleeves in which a static frictional force is greater than a load force. The normal force is an interaction force which is present in the contact zone between two sleeves and which acts perpendicular to the contact surface. The load force is a force that leads to a movement of the body.

The inner sleeve may thus form a kind of press fit or interference fit with the outer sleeve. The diameter of the inner sleeve and the diameter of the outer sleeve are designed in such a way that the inner sleeve can be pushed or inserted into the outer sleeve with an insertion force and that there is a static frictional force which prevents the inner sleeve from slipping out of the outer sleeve, in particular in the case of a certain weight force of the inner sleeve and, if necessary, additionally in the case of a fluid-filled inner sleeve. Thus, a stable and robust container may be provided without providing complex fastening measures between the inner and outer sleeves. Furthermore, slipping of the inner sleeve out of the outer sleeve may be reliably prevented if a fluid in the interior of the inner sleeve or a fluid in a bag system in the interior of the inner sleeve leads to a mechanical pressure load in radial direction towards the outside. In other words, the inner sleeve and the outer sleeve may be pressed against each other if, for example, the inner sleeve or the bag system arranged in the interior of the inner sleeve is filled with a fluid, e.g. aerosol, in such a way that the expansion of the inner sleeve or the bag system in the radial direction towards the outside also leads to an expansion or outward pressure of the inner sleeve against the outer sleeve. If the mechanical pressure load in the radial direction towards the outside decreases, which is induced, for example, by using and emptying the bag system, the compression of the inner and outer sleeves also decreases so that the inner sleeve and the outer sleeve are only coupled by means of static friction and separation is facilitated. Thus, in addition to increasing durability and longevity, also an improved coupling of the inner sleeve and the outer sleeve when the container is filled and an improved separability of the inner and outer sleeves when the container is emptied may be provided.

According to another exemplary embodiment of the disclosure, the diameter of the inner sleeve and the diameter of the outer sleeve are configured such that an outer surface of the inner sleeve and an inner surface of the outer sleeve are coupleable to each other in a substance-to-substance bonded manner (materially bonded manner, material closure).

A substance-to-substance bonded coupling is a connection (in particular an adhesive connection) in which the connecting partners are held together by atomic or molecular forces. Exemplary embodiments of a substance-to-substance bonded adhesion or coupling are soldering, welding, adhesive bonding and vulcanization.

This enables a particularly strong, dimensionally stable and robust container to be provided. Furthermore, a separation of the inner sleeve and the outer sleeve is reliably prevented. Thus, the durability and longevity of the container may be increased.

According to another exemplary embodiment of the disclosure, the container comprises a closure element for closing the second opening of the inner sleeve and/or the fourth opening of the outer sleeve.

In the context of the application, the "closure element" may represent an element, which serves to permanently or non-permanently close at least one opening of a sleeve. Exemplary embodiments of a closure element may represent head disks, caps, pegs, stoppers, corks, plugs, bungs, and studs. In this regard, the closure element may be provided from the same or a different material than that of the sleeves.

The sealing or closing of the container has the advantage that an interior space, which is located in the interior of the container and which accommodates devices or contents located in the container, may be protected from external influences and damage. Furthermore, by closing at least one opening, the interior of the sleeve/sleeves, i.e. the inner surface of the inner sleeve, may be protected from environmental influences, e.g. humidity. Thus, the durability and longevity of the container may be increased.

According to another exemplary embodiment of the disclosure, the closure element is a head disk, in particular a head disk made of paper. The head disk is fastened to the inner sleeve and/or to the outer sleeve such that the second opening and the fourth opening are closed.

The head disk may be fastened to the inner sleeve and/or to the outer sleeve by means of a material connection (adhesive connection). Exemplary connections may be realized by applying an adhesive to the head disk and/or the inner sleeve and/or the outer sleeve. Here, bonding may be realized completely, i.e. along the entire contact surface of the head disk on the inner sleeve and/or outer sleeve, or selectively, preferably by means of three adhesive points. Furthermore, the head disk may be positively clamped between a lower end of the inner sleeve and the outer sleeve.

The adhesive may be a recyclable adhesive. Exemplary embodiments for a recyclable adhesive include the following: Natural rubber, formaldehyde-free dispersion adhesives (PVAC sugar. adhesive), and lignin-based polymer adhesives (LignoGlue). Recyclable adhesives are not limited to the substances mentioned.

Thus, in addition to at least one opening of the sleeves, the closure element may also seal an open cut edge of the inner sleeve and/or the outer sleeve. This may likewise provide protection from environmental influences, such as an entry of atmospheric moisture. Thus, the durability and longevity of the container may be increased.

According to another exemplary embodiment, the closure element comprises a further outer sleeve which is closed on one side by the head disk in such a way that the closure element is slipped over the second opening and the fourth opening.

The further outer sleeve may have a larger diameter than the outer sleeve so that the outer sleeve is insertable into the further outer sleeve.

The closure element may cover the first and third openings and, if necessary, an outer surface of the outer sleeve. This may also provide protection from environmental influences, such as an entry of atmospheric moisture. Thus, the durability and longevity of the container may be increased.

The container may thus be provided with three sleeves. This allows a stable, solid and dimensionally stable container to be provided. Thus, the longevity and durability of the container may be increased.

Further, based on the fact that, for example, a closure element in cap form is slipped over the outer sleeve and the closure element may at least partially or completely cover the outer sleeve and/or the inner sleeve, protection of the outer sleeve against environmental influences, for example air humidity, may be provided. In other words, the length, i.e. extension of the cap in longitudinal direction, of the cap may thus be equal to or different from the length of the inner sleeve and/or outer sleeve.

According to another exemplary embodiment of the disclosure, the further outer sleeve and the head disk are made of paper.

Thus, the CO2 balance as well as the environmental compatibility may be improved. This is enabled by the fact that the container is made entirely of paper, i.e. in addition to the inner sleeve and the outer sleeve, the other outer sleeve and the head disk are also made of paper.

According to another exemplary embodiment of the disclosure, the further outer sleeve comprises a third reinforcing element which extends into the sixth opening. The head disk is coupled to the portion of the third reinforcing element extending into the interior of the further outer sleeve.

The head disk and the reinforcing element may be coupled or fastened to each other by providing, for example, a material connection (adhesive connection) and/or a press connection. Exemplary connections may be realized by applying an adhesive to the head disk and/or the reinforcing element. Here, bonding may be realized completely, i.e. along the entire contact surface of the head disk on the reinforcing element, or selectively, preferably by means of three adhesive points. Furthermore, a connection between the head disk and the reinforcing element may also be realized by means of a press fit or interference fit.

Thus, a stable attachment of the head disk to the reinforcing element may be provided. Falling out or slipping of a head disk may be reliably prevented, thereby increasing the durability and longevity of the container. Furthermore, coupling or arranging the head disk to the portion of the reinforcing element extending into the interior of the sleeve has the advantage that the attachment of the head disk is present within the sleeve, i.e., in the area of the sleeve corresponding to the cylinder volume of the sleeve. As a result, the attachment of the head disk may be protected from environmental influences, which also leads to an increase in the durability and longevity of the container.

According to another exemplary embodiment of the disclosure, the diameter of the outer sleeve and the diameter of the further outer sleeve are configured such that an outer surface of the outer sleeve and an inner surface of the further outer sleeve are frictionally coupled to each other.

Thus, the inner sleeve can be inserted into the outer sleeve and the outer sleeve in turn into the further outer sleeve so that slipping out of the sleeves may be prevented by means of static friction. Furthermore, slipping out of the sleeves may be reliably prevented if the functional insert is a device which leads to a mechanical pressure load in the radial direction towards the outside. In other words, the sleeves, i.e. inner, outer and further outer, may be pressed against each other if, for example, a bag system arranged inside the container is filled with a fluid, e.g. an aerosol, or a printed or pressurized fluid is present inside the inner sleeve in such a way that the expansion of the bag system or the inner sleeve in the radial direction towards the outside also leads to an expansion or outward pressing of the sleeves. If the mechanical pressure load in the radial direction decreases towards the outside, which is induced, for example, by the use and emptying of the bag system, the compression of the sleeves also decreases so that the sleeves are coupled only by means of static friction and separation thereof is facilitated. Thus, in addition to increasing durability and longevity, an improved coupling of the sleeves when the container is filled and an improved separability of the sleeves when the container is emptied may be provided.

The diameter of the outer sleeve and the diameter of the further outer sleeve may be configured such that an outer surface of the outer sleeve and an inner surface of the further outer sleeve are coupleable to each other in a substance-to-substance bonded manner.

According to another exemplary embodiment of the disclosure, a predetermined breaking point is formed in the inner sleeve and/or the outer sleeve in such a way that a tool-free separation of the first sleeve and/or the second sleeve can be provided.

The area of the sleeves at the predetermined breaking point is weakened in such a way that the predetermined breaking point may be separated manually without the use of tools, e.g. a cutting tool, merely by means of pure muscle power.

Thus, the functional insert and the sleeves may be separated by pure muscle power and without the use of tools by destroying at least one sleeve at the predetermined breaking point and releasing the jamming or deadlock of the functional insert. Thus, the recyclability of a container according to the disclosure may be increased.

According to another exemplary embodiment, the predetermined breaking point forms a region of the inner sleeve and/or the outer sleeve which is less robust than a region of the corresponding inner sleeve and/or the outer sleeve surrounding the predetermined breaking point. The predetermined breaking point may in particular comprise a notch, a perforation, a scribe mark, a spatially limited embrittled region and/or a material taper.

The predetermined breaking point thus defines a point determined by a particular structure, shape or design which breaks predictably under a predefined load or overload. The predetermined breaking point, for example a perforated area, may, for example, be integrated along the longitudinal direction in the skin surface of the corresponding sleeve. Furthermore, the predetermined breaking point may be formed in the circumferential direction of the inner sleeve or the outer sleeve. The further outer sleeve described above may also have a described predetermined breaking point.

According to another exemplary embodiment of the disclosure, at least the first reinforcing element and/or the second reinforcing element (and/or the third reinforcing element) comprises a bead, in particular a flange.

The bead may be a full or partial circumferential bead which extends from the (inner) skin surface of the sleeve into the interior or the inner volume of the sleeve. A flange represents a thickening or bead which, by means of beading or flanging, i.e. bending an edge of the sleeve into the interior, leads to stiffening of the bent edge of the sleeve. Exemplary embodiments of a bead may represent a flange with a round cross-section, a structure made of an adhesive, or a flange with a round cross-section that is compressed.

A bead provides a reinforcing element that may reliably secure the functional insert inside the sleeves in a simple and inexpensive manner. Thus, the durability and longevity of a container according to the disclosure may be increased.

According to another exemplary embodiment of the disclosure, an outer surface of the inner sleeve and/or an inner surface of the inner sleeve is provided with a coating. Alternatively or additionally, an outer surface of the outer sleeve and/or an inner surface of the outer sleeve is provided with a coating.

Further alternatively or additionally, an outer surface of the further outer sleeve and/or an inner surface of the further outer sleeve may be provided with a coating.

The outer surface of a sleeve is in direct contact with an environment of the sleeve and is thus exposed to environmental influences. The inner surface represents the surface of the sleeve which is present in the interior of the sleeve and at least partially encloses an inner volume of the sleeve. In a further embodiment, the inner surface of the head disk, which is present in the interior of the sleeve, and/or the outer surface of the head disk, which is in direct contact with the environment, may also be provided with a coating.

A coating may be applied to the outer or inner surface of a sleeve. A coating may have an impermeability so that the layers of the sleeve, which are made of paper, are insulated, sealed or encapsulated. Exemplary embodiments for coatings include thin layers of plastic (e.g., polypropylene or polyethylene), metal foils (e.g., of copper, silver, aluminum), varnish, or paper layers that have a different basis weight than the layers of the sleeve. The exemplary embodiments are not limited to the above-mentioned materials.

The coating on a sleeve has a total weight of less than 20%, in particular less than 5%, of the total weight of the corresponding coated sleeve to ensure recyclability of the container.

Thus, the resistance of the sleeves to e.g. grease, oil and water may be improved and the longevity of the container may be increased.

According to another exemplary embodiment of the disclosure, the inner sleeve and/or the outer sleeve and/or the further outer sleeve consist of a plurality of layers, in particular two layers.

Furthermore, the further outer sleeve may also consist of a plurality of layers, in particular two layers.

By means of the corresponding number of layers, any thicknesses of the corresponding sleeves can be set. This may increase the strength and dimensional stability of the sleeve. Sleeves with two layers may be a price-optimized variant of the sleeves.

According to another exemplary embodiment of the disclosure, at least one of the inner sleeve and the outer sleeve is a spirally wound sleeve.

Furthermore, the further outer sleeve may also be a spirally wound sleeve.

The sleeves are produced in a spiral winding process in which, depending on the intended use and the associated strength requirements, at least one sized paper web is wound onto a fixed mandrel in a partially overlapping manner or butt-wound against one another. Each sized paper web represents one layer of a winding. During the spiral winding process, single plies, several single plies on top of each other, or several single plies overlapping into each other can be wound. To provide the layers, the edges of the paper webs may overlap in the longitudinal direction of the sleeve, with the overlapping areas of the paper webs being fastened together, in particular glued.

The production of the sleeves by spiral winding of paper webs into sleeves, results in a robust, resistant and cost-effective container that is tight against aerosols or other fluids.

According to another exemplary embodiment of the disclosure, the functional insert comprises a bag member (bag element, pouch member) for holding a fluid and a support member to which the bag member is attached, wherein the bag member extends from the support member into the interior of the first sleeve.

According to another exemplary embodiment of the disclosure, the bag member is designed to be elastically deformable such that the bag member is expandable by means of the fluid inside the bag member.

With the elastically deformable bag member, a pressure may be applied to a fluid contained in the bag member so that an improved outflow of the fluid from the bag member may be provided. Furthermore, the expansion of the elastically deformable bag member causes the bag member to exert a compressive force on the inner surface of the inner sleeve so that an interference fit is provided between the inner sleeve and the outer sleeve.

Furthermore, the expansion of the elastically deformable bag member may also result in an interference fit or press fit between the inner sleeve, the outer sleeve and the further outer sleeve.

According to a further exemplary embodiment of the disclosure, the functional insert comprises a valve insert through which a fluid inside the first sleeve is selectively dischargeable.

Further, the functional insert may include a cartridge, a baffle, or a pumping device for pumping out the fluid.

It is pointed out that embodiments described herein represent only a limited selection of possible embodiments of the disclosure. Thus, it is possible to combine the features of individual embodiments in a suitable manner so that a multitude of different embodiments are to be regarded as obviously disclosed to a person skilled in the art with the embodiment variants made explicit herein.

DETAILED DESCRIPTION

Figure 1:
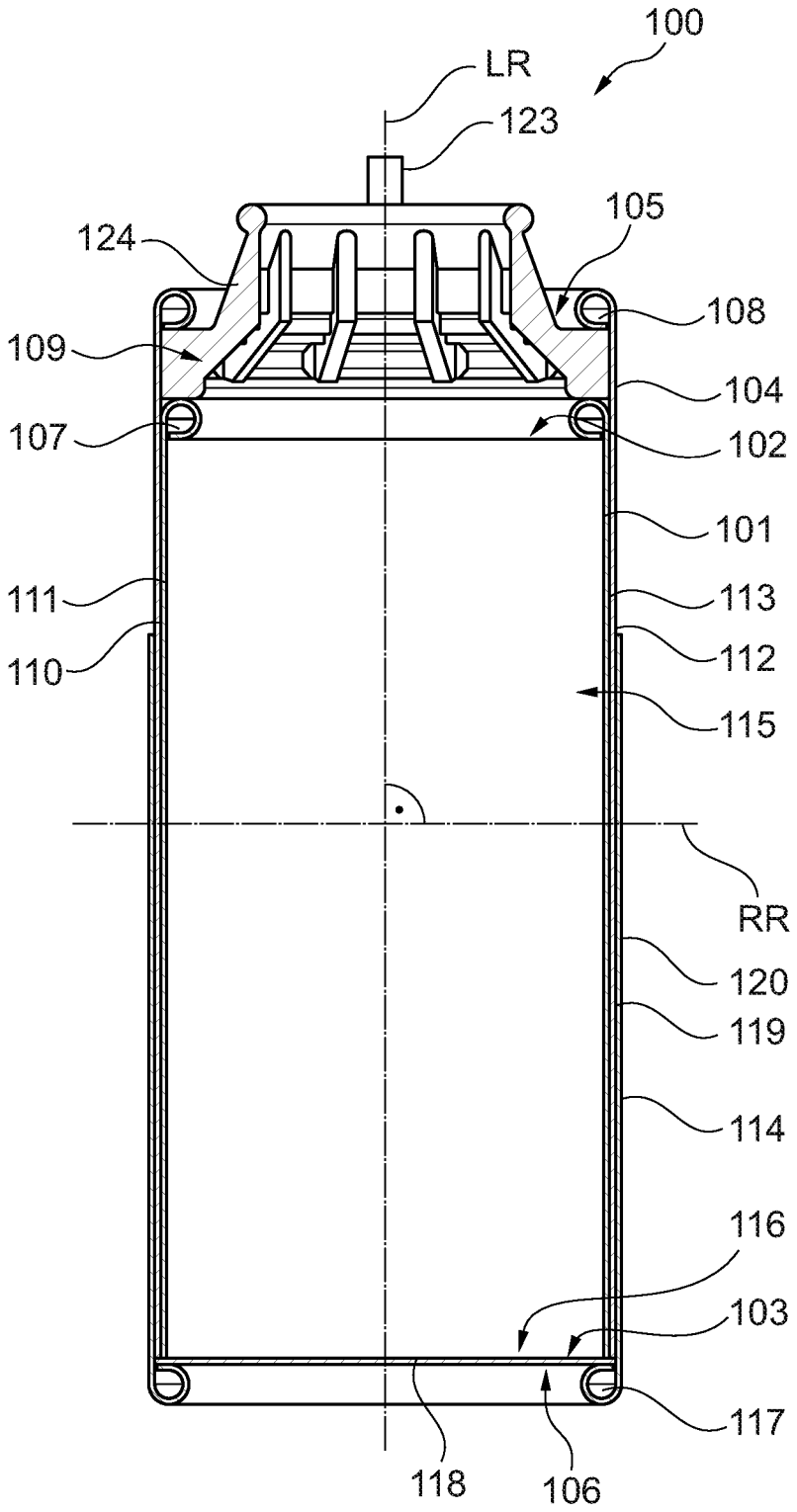
FIG. 1 shows a schematic sectional view of an exemplary embodiment of the container according to the disclosure, the container consisting in particular of three sleeves.

It is pointed out that in the following detailed description, features or components of different embodiments which are identical or at least functionally identical to the corresponding features or components of another embodiment are provided with the same reference signs or with reference signs which are identical in the last two digits to the reference signs of corresponding identical or at least functionally identical features or components. To avoid unnecessary repetitions, features or components already explained on the basis of a previously described embodiment will not be explained again in detail at a later point.

It is also noted that the representation in the figures is schematic and not to scale.

It is further noted that space-related terms, such as "front" and "back," "top" and "bottom," "left" and "right," etc., are used to describe the relationship of an element to another element or elements, as illustrated in the figures. Accordingly, the space-related terms may apply to orientations which are different from the orientations illustrated in the figures. It is understood, however, that all such space-related terms refer to the orientations shown in the drawings for the sake of simplicity of description and are not necessarily limiting, since the particular device, component, etc. shown, when in use, may assume orientations that may be different from the orientations shown in the drawing.

FIG. 1 shows a schematic sectional view of an exemplary embodiment of the container 100 according to the disclosure for holding a fluid, in particular an aerosol. The container 100 comprises an inner sleeve 101 having a first opening 102 and a second opening 103 opposite the first opening 102. Further, the container 100 comprises an outer sleeve 104 having a third opening 105 and a fourth opening 106 opposite the third opening 105. The inner sleeve 101 and the outer sleeve 104 are made of paper. The first opening 102 comprises a first reinforcing element 107 which extends into the first opening 102, and the third opening 105 comprises a second reinforcing element 108 which extends into the third opening 105. Further, the container 100 comprises a functional insert 109. The outer sleeve 104 has a larger diameter than the inner sleeve 101 so that the inner sleeve 101 is insertable into the outer sleeve 104 through the fourth opening 106 such that the insert 109 is fastened between the first reinforcing element 107 and the second reinforcing element 108.

The reinforcing element 107 is a full circumferential bead which extends from the skin surface of the inner sleeve 101 into the interior or inner volume of the inner sleeve 101 and contributes to the stiffening, mechanical strength and dimensional stability of the inner sleeve 101. In this case, the reinforcing element 107 is a flange with a round cross-section, which extends into the interior, i.e. into the cylindrical volume of the inner sleeve 101.

The inner sleeve 101 is in particular a spirally wound sleeve which is made of paper, in particular of at least two paper layers. In the embodiment according to the disclosure shown in FIG. 1, an inner surface 111 and an outer surface 110 of the inner sleeve 101 may be provided with a coating. Coatings of the inner sleeve 101 serve in this case to improve the resistance of the inner sleeve 101 to, for example, grease, oil and water.

The outer sleeve 104 comprises a reinforcing element 108, which is also a flange with a circular cross-section that extends into the interior of the outer sleeve 104. The outer sleeve 104 is also a spirally wound sleeve, which is made of two layers of paper. The inner surface 113 and the outer surface 112 of the outer sleeve 104 may be provided without coating or with coating.

The inner sleeve 101 has an outer diameter which is smaller than the inner diameter of the outer sleeve 104. The outer diameter of the inner sleeve 101 and the inner diameter of the outer sleeve 104 are configured in such a way that the outer surface 110 of the inner sleeve 101 and the inner surface 113 of the outer sleeve 104 are almost completely in contact. In particular, the inner sleeve 101 may thus be fastened to each other with the outer sleeve 104 by means of an interference fit. The outer diameter of the inner sleeve 101 and the inner diameter of the outer sleeve 104 are formed in such a way that the inner sleeve 101 is inserted into the outer sleeve 104 with an insertion force and that a static frictional force is present. The static frictional force prevents the inner sleeve 101 from slipping out of the outer sleeve 104.

The inner sleeve 101 has a shorter length in the longitudinal direction LR than the outer sleeve 104 so that an area is provided between the first reinforcing element 107 and the second reinforcing element 108 in the interior of the outer sleeve 104, which is configured such that a functional insert 109 is arranged and fastened within said area.

As shown in FIG. 1, the functional insert 109 may form a valve carrier 124 that supports a valve 123. The functional insert 109 may be made of plastic and thus differ from the recyclable material of the sleeves 101, 104.

The functional insert 109 has a diameter that is smaller than the inner diameter of the outer sleeve 104. Further, the diameter of the functional insert 109 is larger than the free diameter of the third opening 105, which is not constrained or restricted by the second reinforcing element 108. As a result, the functional insert 109 may be inserted through the fourth opening 106 of the outer sleeve 104 and may be applied to the second reinforcing element 108. Additionally, the diameter of the functional insert 109 is larger than the free diameter of the first opening 102, which is not constrained or restricted by the first reinforcing element 107. Thus, after the functional insert 109 is applied to the second reinforcing element 108, the inner sleeve 101 may be pushed or inserted into the outer sleeve 104 so that the inner sleeve 101 and the first reinforcing element 107 press the functional insert 109 against the first reinforcing element 108. The functional insert 109 is thus clamped and fixed between the first reinforcing element 107 and the second reinforcing element 108.

Furthermore, the container 101 comprises a closure element. The closure element comprises a head disk 118 and a further outer sleeve 114. The further outer sleeve 114 comprises a fifth opening 115 and a sixth opening 116, which are arranged opposite each other. The further outer sleeve 114 is also a spirally wound sleeve, which consists of two paper layers. The inner surface 119 and the outer surface 120 of the further outer sleeve 104 may be provided without or with a coating.

The head disk 118 is fastened to a third reinforcing element 117 which is provided at the sixth opening 116 of the further outer sleeve 114. The third reinforcing element 114 may be formed as a flange having a circular cross-section. A fastening of the head disk 118 to the third reinforcing element 117 is provided by means of a material connection (adhesive connection) and/or a press connection. In this case, in particular in the case of the adhesive connection, a fastening of the head disk to the third reinforcing element 117 is realized by means of a complete or punctual adhesive bond, preferably by means of three adhesive points.

The inner diameter of the further outer sleeve 114 and the outer diameter of the outer sleeve 104 are configured here in such a way that the outer surface 112 of the outer sleeve 104 and the inner surface 119 of the further outer sleeve 114 are almost completely in contact. Here, the outer sleeve 104 is formed with the further outer sleeve 114 in a kind of interference fit. The outer diameter of the outer sleeve 104 and the inner diameter of the further outer sleeve 114 are formed in such a way that the outer sleeve 104 is pushed or inserted into the further outer sleeve 114 with an insertion force and that a static frictional force is present. The static frictional force prevents the outer sleeve 104 from slipping out of the further outer sleeve 114.

The further outer sleeve 114 has a length which is smaller than the length of the inner sleeve 101 and/or the outer sleeve 104 in a longitudinal direction LR. Thus, the closure element may at least partially or completely cover the outer surface 110 and 112 of the inner and outer sleeves 101 and 104.

Furthermore, depending in particular on the static friction and the length of the further outer sleeve 104, the closure element serves as a kind of stopper so that a force acting on the valve carrier 124 in the longitudinal direction LR does not cause the inner sleeve 101 and the valve carrier 124 to be pressed out of the outer sleeve 104. This stopping function is provided by the fact that the one force acting on the valve carrier 124 in the longitudinal direction LR must not only be stronger than the static friction force between the inner sleeve 101 and the outer sleeve 104, but must also be stronger than a superposition of the static friction force between the inner sleeve 101 and the outer sleeve 104 and the static friction force between the outer sleeve 104 and the further outer sleeve 114.

Figure 2:
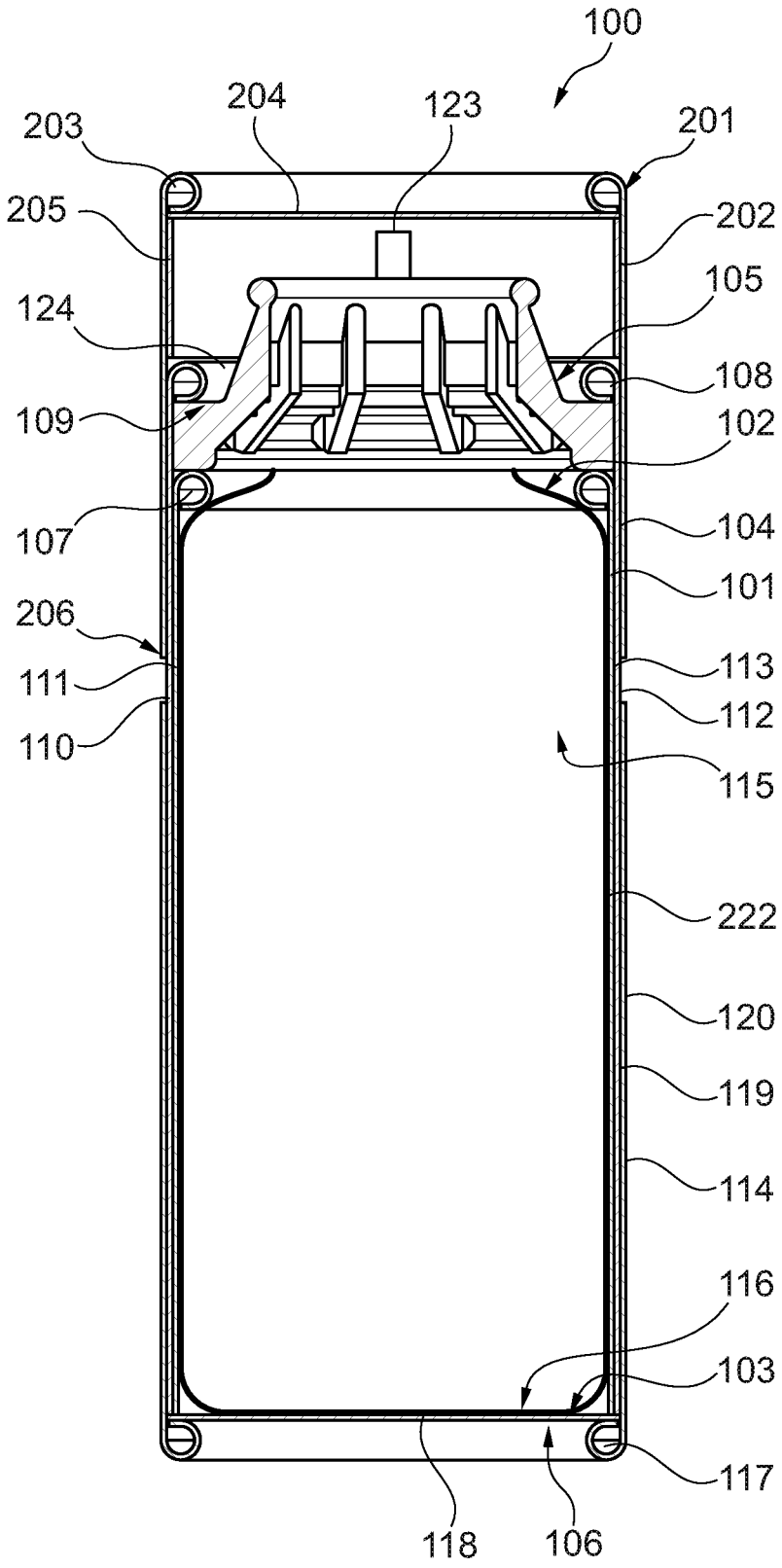
FIG. 2 shows a schematic sectional view of an exemplary embodiment of the container according to FIG. 1 with cap.

FIG. 2 shows a schematic sectional view of an exemplary embodiment of the container 100 according to FIG. 1. The container 100 shown in FIG. 2 is provided with a cap 201. This cap 201 may also be provided by means of a spirally wound sleeve 202 made of paper, a reinforcing element 203 extending into the interior of the sleeve 202, which is a flange having a round cross-section, and a cover disk 204 coupled to the reinforcing element 203 in the interior of the sleeve. Here, a length of the cap 201 in the longitudinal direction LR and the inner diameter of the cap 201 are configured such that the cap 201 can be partially or fully slipped over the outer surface 112 of the outer sleeve 104. Here, the inner diameter of the cap 201 may be identical to the inner diameter of the further outer sleeve 114. As a result, the inner diameter of the cap 201 and the outer diameter of the outer sleeve 104 are also configured such that the cap 201 is formed with the further outer sleeve 114 in a kind of interference fit. The outer diameter of the outer sleeve 104 and the inner diameter of the cap 201 are thus designed such that the cap 201 is pushed onto the outer sleeve 104 with a thrust force, and such that a static frictional force is present. The static frictional force prevents the cap 201 from slipping off the outer sleeve 104.

Further, the cap 201 comprises an inlay 205 that may be used to define or set a seating depth, i.e., a depth at which the container 100 is inserted into the cap 201, i.e., the inlay is configured to serve as a stop. The inlay is a spirally wound sleeve or a bead that is materially or frictionally fastened in the sleeve 202 of the cap 201. With the aid of the inlay, a recessed grip 206 may be provided by forming the cap 201 and the closure element such that the outer sleeve 104 is exposed in a region.

In addition to the static frictional forces acting between the inner sleeve 101, the outer sleeve 104 and the further outer sleeve 114, as already described in detail for FIG. 1, slipping of the inner sleeve 101 out of the outer sleeve 104 and of the outer sleeve 104 out of the further outer sleeve 114 may also be reliably prevented if a fluid inside the inner sleeve or a fluid in a bag system 222 inside the inner sleeve 101 leads to a mechanical pressure load in the radial direction RR towards the outside. In other words, the inner sleeve 101, the outer sleeve 104 and the further outer sleeve 114 may be pressed against each other when, for example, the inner sleeve 101 or the bag system 222 arranged inside the inner sleeve 101 is filled with a fluid, e.g. aerosol, in such a way that the expansion of the inner sleeve 101 or of the bag system 222 in radial direction RR towards the outside also leads to an expansion or to an outward pressing of the inner sleeve 101 against the outer sleeve 104 and against the further outer sleeve 114. If the mechanical pressure load in the radial direction RR decreases towards the outside, which is induced for example by the use and the emptying of the bag system 222, the compression of the inner 110, the outer 104 and the further outer sleeve 114 also decreases so that the sleeves 101, 104 and 114 are coupled only by means of the static friction and a separation is facilitated.

Figure 3:
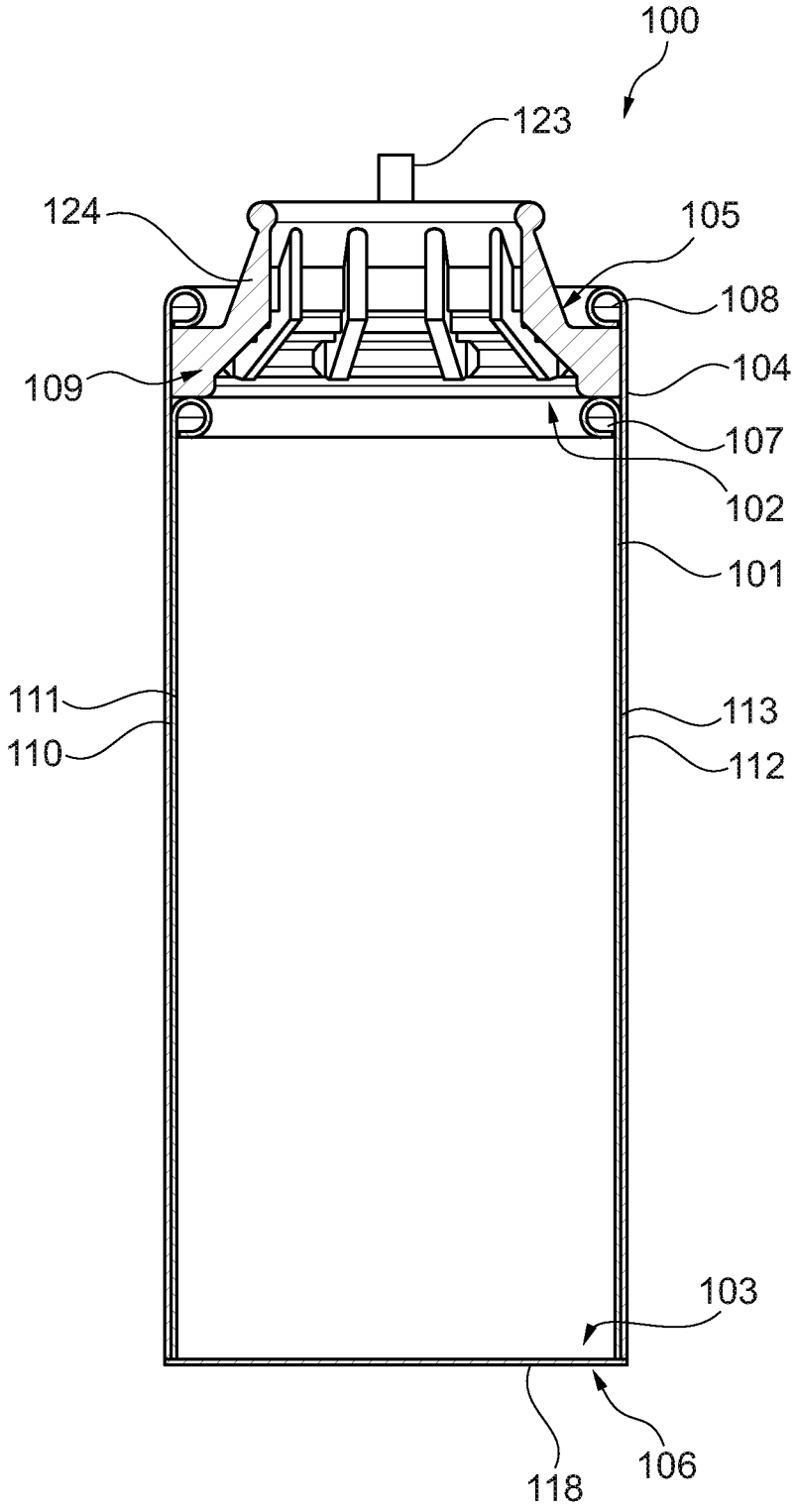
FIG. 3 shows a schematic sectional view of a further exemplary embodiment of the container according to the disclosure, the container consisting in particular of two sleeves.

FIG. 3 shows a schematic sectional view of an exemplary further embodiment of the container 100 according to the disclosure, the container 100 consisting in particular of two sleeves. The container 100 shown in FIG. 3 also comprises an inner sleeve 101 and an outer sleeve 104, which are provided by means of spiral winding and consist of two paper webs. The inner sleeve 101 comprises a first reinforcing element 107 and the outer sleeve 104 comprises a second reinforcing element 108. Furthermore, the container 100 comprises a closure element. In the embodiments according to the disclosure shown in FIGS. 3 and 4, the closure element represents a head disk 118, which is fastened in a substance-to-substance bonded manner to the second opening 103 of the inner sleeve 101. A substance-to-substance or material bond is provided in this case by means of complete or punctual adhesion of the head disk 118 to the inner sleeve 101, in particular to the edge of the second opening 103. Alternatively, the closure element in FIGS. 3 and 4 may be a head disk 118 which is placed on the second opening 103 of the inner sleeve 101, i.e., not coupled in a substance-to-substance bonded manner, and is fastened by means of a reinforcing element which is provided at the fourth opening 106 of the outer sleeve 104 after the head disk has been placed on the second opening 103. Here, the inner diameter of the outer sleeve 104 and the outer diameter of the inner sleeve 101 are again configured such that the inner surface 113 of the outer sleeve 104 and the outer surface 110 of the inner sleeve provide a kind of interference fit. Thus, the inner sleeve 101 and the outer sleeve 104 are frictionally coupled to each other, i.e. by means of a static frictional force, so that the inner sleeve 101 is prevented from slipping out of the outer sleeve 104.

In addition to the static frictional force which couples the inner sleeve 101 and the outer sleeve 104 to each other, in this exemplary embodiment according to the disclosure, slipping of the inner sleeve 101 out of the outer sleeve 104 may also be prevented by means of a crimping or compression, as described at FIG. 2, of the sleeves 101 and 104.

Figure 4:
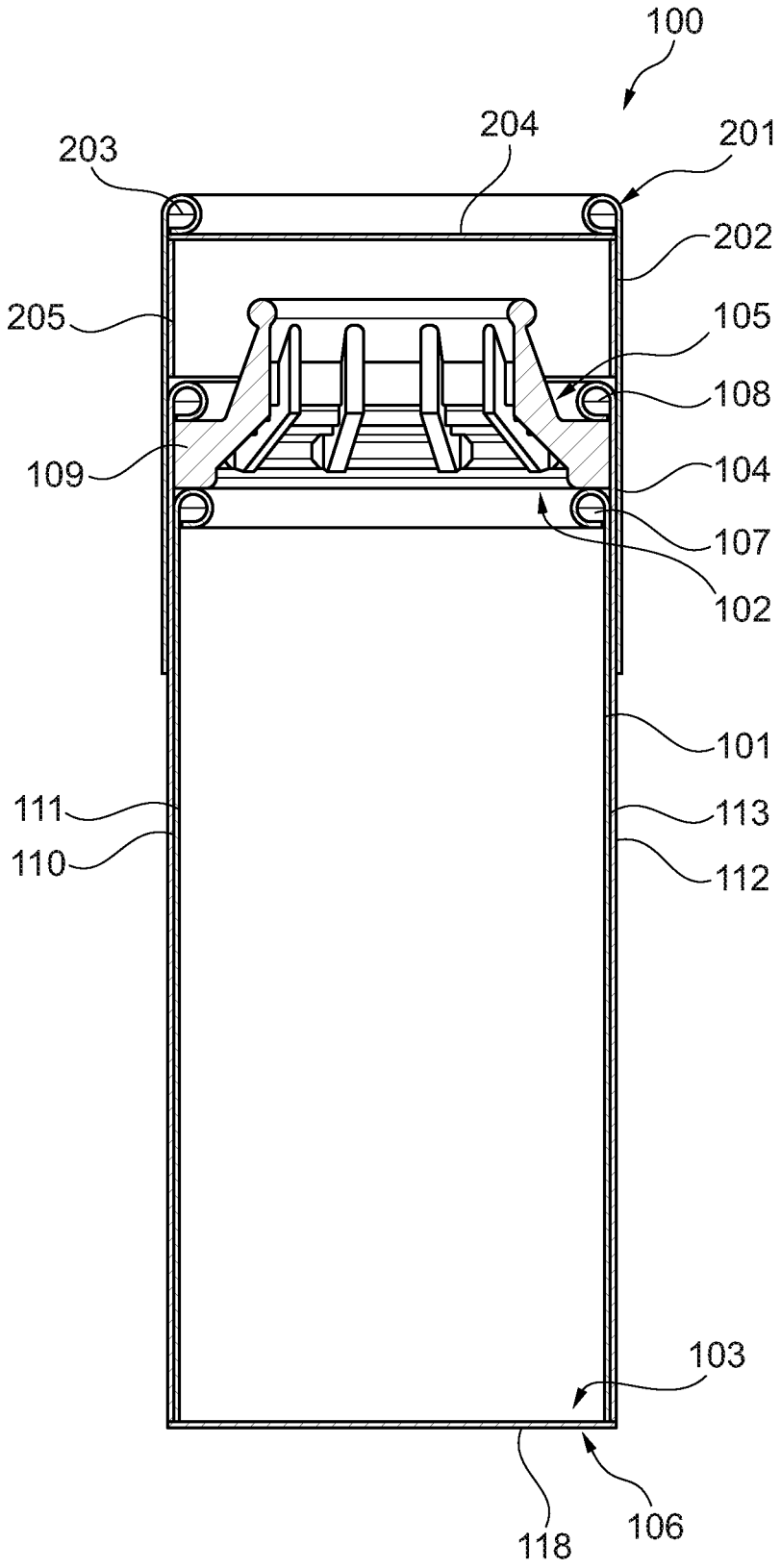
FIG. 4 shows a schematic sectional view of a further exemplary embodiment of the container according to FIG. 3 with cap.

FIG. 4 shows a schematic sectional view of an exemplary further embodiment of the container according to FIG. 3. In the embodiment according to the disclosure shown in FIG. 4, the container 100 of FIG. 3 is provided with a cap 202 as already described in FIG. 2.

Figure 5:
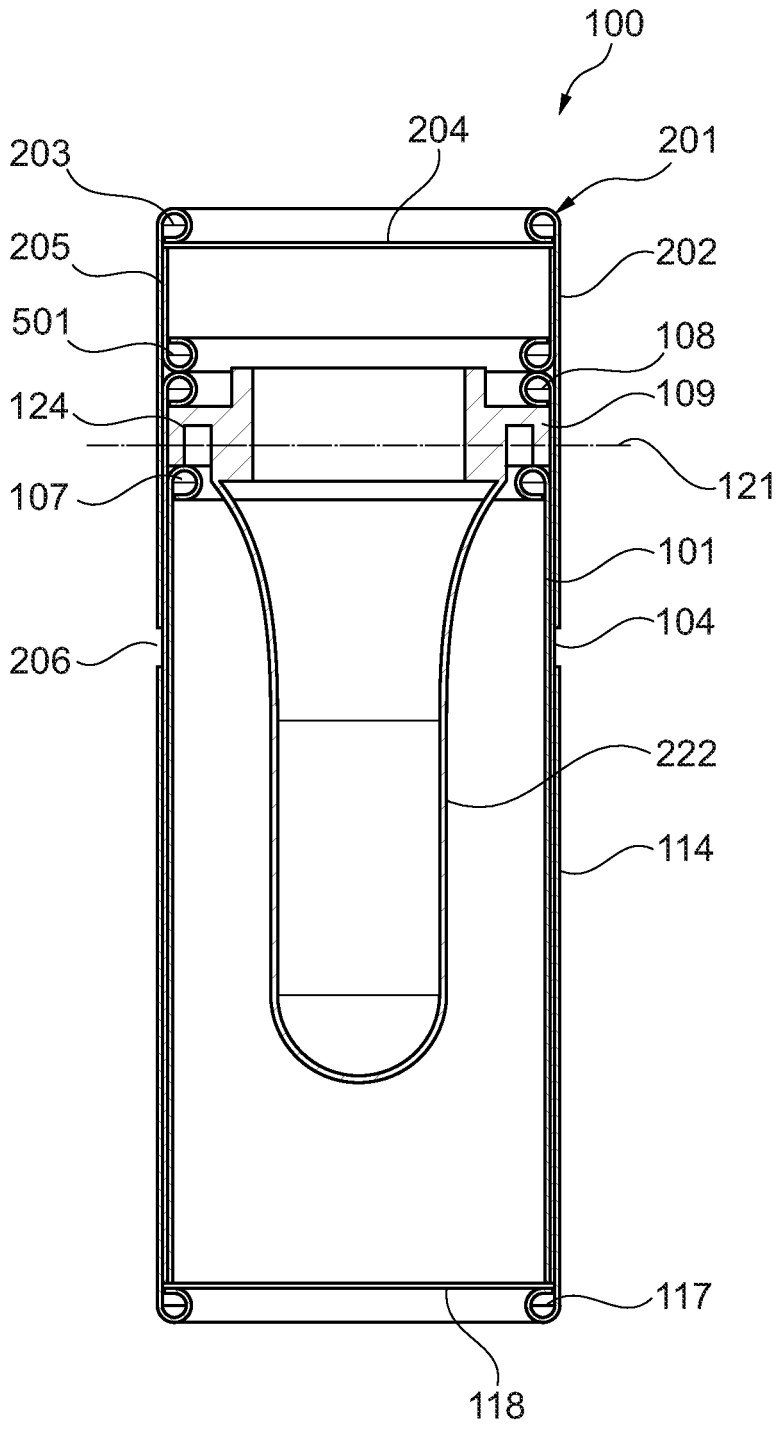
FIG. 5 shows a schematic sectional view of a further exemplary embodiment of the container according to the disclosure with three sleeves.

FIG. 5 shows a schematic sectional view of an exemplary further embodiment of the container 100 according to the disclosure, the container 100 consisting in particular of three sleeves. The container 100 shown in FIG. 5 comprises, just like the container 100 shown in FIG. 1 and FIG. 2, a spirally wound inner sleeve 101, a spirally wound outer sleeve 108 and a closure element comprising a spirally wound further outer sleeve 114 and a head disk 118. The inner sleeve 101, outer sleeve 108, and further outer sleeve 114 all include a reinforcing element at an opening. In contrast to the exemplary embodiment according to the disclosure of FIGS. 1 and 2, the inner sleeve 101 and/or the outer sleeve 104 and/or the further outer sleeve 114 are coupled to each other in a substance-to-substance bonded manner. Adhesives, in particular recyclable adhesives, are used for providing a substance-to-substance bonded coupling. The coupling is provided here by means of a complete bonding of the sleeves 101, 104 and 114.

A separability of the sleeves 101, 104 and 114 may be provided here by releasing or breaking the substance-to-substance bonded coupling by a torsional movement in the emptied state of the container so that a separation of the sleeves 101, 104 and 114 is made possible.

A separability of recyclable elements, i.e. the spirally wound paper sleeves 101, 104 and 114, and elements, i.e. the functional insert, may be provided in the further exemplary embodiments according to the disclosure as shown in FIGS. 3 to 5 by means of a predetermined breaking point 121. The predetermined breaking point 121 is provided in the outer sleeve 104 in a region between the first reinforcing element 107 and the second reinforcing element 108. As a result, recyclable elements and non-recyclable elements of the container 100 may be easily separated from each other by a tool-free, manual breaking of the predetermined breaking point 121.

The predetermined breaking point 121 may be a perforated region or perforation in the circumferential direction on the outer sleeve 104 and/or on the inner sleeve 101. The perforation of the outer sleeve 104 and/or of the inner sleeve 101 weakens the sleeve/sleeves 101 and 104 in the region of the predetermined breaking point 212 in such a way that the sleeves 101 and 104 can be separated destructively by hand by means of pure muscle power without the use of tools.

In addition to the substance-to-substance bonding between the inner sleeve 101, the outer sleeve 104 and the further outer sleeve 114, a coupling of the inner sleeve 101, the outer sleeve 104 and, if applicable, the further outer sleeve 114 may furthermore be reliably provided if a fluid inside the inner sleeve or a fluid in a, in particular elastically deformable, bag system 222 inside the inner sleeve 101 leads to a mechanical pressure load against the sleeves 101, 104 in the radial direction RR towards the outside. In other words, the inner sleeve 101, the outer sleeve 104 and, if applicable, the further outer sleeve 114 may be pressed against each other if, for example, the inner sleeve 101 or the bag system 222, which is arranged inside the inner sleeve 101, is filled with a fluid, e.g. aerosol, in such a way that the outward expansion of the inner sleeve 101 or of the bag system 222 in radial direction RR also leads to an expansion or to an outward pressing of the inner sleeve 101 against the outer sleeve 104 and against the further outer sleeve 114.

Further, the container 100 shown in FIG. 5 is provided with a cap 201 as described with respect to FIG. 2.

In contrast to the cap 201 described in FIG. 2, the inlay 205 of the cap 201 in FIG. 5 has a thickened structure 501, which is a flange with a round cross-section and which also defines or fixes a seating depth of the cap 201 on the container 100, i.e. the inlay is configured in such a way that it serves as a stop. With the aid of this inlay 205, a recessed grip 206 is provided in that the cap 201 and the closure element are configured in such a way that the outer sleeve 104 remains exposed in one region.

It is noted that the terms "comprise" or "have" do not exclude other elements and that the "a" does not exclude a plurality. Also, elements described in connection with different embodiments may be combined. It should also be noted that reference signs in the claims should not be construed as limiting the scope of the claims.

REFERENCE SIGNS

100 container
101 inner sleeve

102 first opening
103 second opening
104 outer sleeve
105 third opening
106 fourth opening
107 first reinforcing element
108 second reinforcing element
109 insert
110 outer surface
111 inner surface
112 outer surface
113 inner surface
114 further outer sleeve
115 fifth opening
116 sixth opening
117 third reinforcing element
118 head disk
119 inner surface
120 outer surface
121 predetermined breaking point
123 valve
124 valve carrier
201 cap
202 sleeve
203 reinforcing element
204 cover disk
205 inlay
206 recessed grip
222 bag member
501 thickened structure
LR longitudinal direction
RR radial direction

The invention claimed is:

1. A container for holding a fluid, the container comprising:

an inner sleeve having a first opening and a second opening opposite the first opening;

an outer sleeve having a third opening and a fourth opening opposite the third opening;

wherein the inner sleeve and the outer sleeve are made of paper, wherein the inner sleeve comprises at the first opening a first reinforcing element which extends into the first opening, wherein the outer sleeve comprises at the third opening a second reinforcing element which extends into the third opening;

a functional insert, wherein the outer sleeve has a larger diameter than the inner sleeve so that the inner sleeve is insertable into the outer sleeve through the fourth opening such that the insert is fastened between the first reinforcing element at the first opening and the second reinforcing element at the third opening, wherein the inner sleeve forms a shorter length in a longitudinal direction than the outer sleeve, so that an area is formed between the first reinforcing element and the second reinforcing element in an interior of the outer sleeve, which is configured such that the functional insert is arranged and fastened within the area.

2. The container according to claim 1, wherein the diameter of the inner sleeve and the diameter of the outer sleeve are configured such that an outer surface of the inner sleeve and an inner surface of the outer sleeve are frictionally coupled to each other.

3. The container according to claim 1, wherein the diameter of the inner sleeve and the diameter of the outer sleeve are configured such that an outer surface of the inner sleeve and an inner surface of the outer sleeve are coupleable to each other in a substance-to-substance bonded manner.

4. The container according to claim 1, further comprising:

a closure element for closing at least one of the second opening of the inner sleeve and the fourth opening of the outer sleeve.

5. The container according to claim 4, wherein the closure element comprises a head disk, wherein the head disk is fastened to at least one of the inner sleeve and the outer sleeve such that the second opening and the fourth opening are closed.

6. The container according to claim 5, wherein the closure element comprises a further outer sleeve which is closed on one side by the head disk in such a way that the closure element is slipped over the second opening and the fourth opening.

7. The container according to claim 6, wherein the further outer sleeve and the head disk are made of paper.

8. The container according to claim 6, wherein the further outer sleeve comprises a third reinforcing element which extends into the sixth opening, wherein the head disk is coupled to the portion of the third reinforcing element extending into the interior of the further outer sleeve.

9. The container according to claim 6, wherein the diameter of the outer sleeve and the diameter of the further outer sleeve are configured such that an outer surface of the outer sleeve and an inner surface of the further outer sleeve are frictionally coupled to each other.

10. The container according to claim 1, wherein a predetermined breaking point is formed in at least one of the inner sleeve and the outer sleeve such that a tool-free separation of at least one of the first sleeve and the second sleeve is providable.

11. The container according to claim 10, wherein the predetermined breaking point forms a region of the inner sleeve and/or the outer sleeve which is less robust than a region of the corresponding inner sleeve and/or the outer sleeve surrounding the predetermined breaking point.

12. The container according to claim 11, wherein the predetermined breaking point comprises at least one of a notch, a perforation, a scribe mark, a spatially limited embrittled region and a material taper.

13. The container according to claim 1, wherein at least one of the first reinforcing element and the second reinforcing element comprises a bead.

14. The container according to claim 1, wherein at least one of an outer surface of the inner sleeve and an inner surface of the inner sleeve is provided with a coating, and/or wherein at least one of an outer surface of the outer sleeve and an inner surface of the outer sleeve is provided with a coating.

15. The container according to claim 1, wherein at least one of the inner sleeve and the outer sleeve consists of a plurality of layers.

16. The container according to claim 1, wherein at least one of the inner sleeve and the outer sleeve is a spirally wound sleeve.

17. The container according to claim 1, wherein the functional insert comprises a bag member for holding a fluid and a support member to which the bag member is attached, wherein the bag member extends from the support member into the interior of the first sleeve.

18. The container according to claim 17, wherein the bag member is designed to be elastically deformable such that the bag member is expandable by means of the fluid inside the bag member.

19. The container according to claim 1, wherein the functional insert comprises a valve insert through which a fluid inside the first sleeve is selectively dischargeable.

* * * * *